US007533981B2

(12) United States Patent
Yun

(10) Patent No.: US 7,533,981 B2
(45) Date of Patent: May 19, 2009

(54) IMAGE-FORMING APPARATUS AND PRINT MEDIA RECOGNITION METHOD THEREFOR

(75) Inventor: Young-jung Yun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 286 days.

(21) Appl. No.: 11/158,098

(22) Filed: Jun. 22, 2005

(65) Prior Publication Data

US 2006/0017796 A1 Jan. 26, 2006

(30) Foreign Application Priority Data

Jul. 20, 2004 (KR) ..... 10-2004-0056534

(51) Int. Cl.
*B41J 2/01* (2006.01)
*B41J 2/435* (2006.01)

(52) U.S. Cl. ..... 347/101; 347/224; 347/227; 347/234

(58) Field of Classification Search ..... 347/224, 347/236, 233, 247, 234, 101
See application file for complete search history.

(56) References Cited

U.S. PATENT DOCUMENTS

| | | | | |
|---|---|---|---|---|
| 5,710,589 | A * | 1/1998 | Genovese | 347/262 |
| 5,764,251 | A * | 6/1998 | Hashimoto | 347/16 |
| 6,400,912 | B1 * | 6/2002 | Tanaka et al. | 399/45 |
| 6,650,354 | B2 * | 11/2003 | Morizono et al. | 347/255 |
| 6,917,374 | B2 * | 7/2005 | Ohide | 347/131 |
| 6,984,034 | B2 * | 1/2006 | Tsujimoto | 347/105 |
| 6,994,432 | B2 * | 2/2006 | Scofield et al. | 347/105 |
| 7,061,514 | B2 * | 6/2006 | LeVake et al. | 347/116 |
| 2001/0008275 | A1 * | 7/2001 | Yanagiuchi | 250/559.4 |
| 2003/0016399 | A1 * | 1/2003 | Hiromatsu | 358/474 |
| 2003/0137679 | A1 * | 7/2003 | Nakazawa et al. | 358/1.6 |
| 2004/0212672 | A1 * | 10/2004 | Satoh et al. | 347/234 |
| 2005/0190212 | A1 * | 9/2005 | Hawver | 347/5 |
| 2006/0158472 | A1 * | 7/2006 | Endo | 347/14 |

FOREIGN PATENT DOCUMENTS

| | | |
|---|---|---|
| CN | 1347368 | 5/2002 |
| JP | 04-106692 | 4/1992 |
| JP | 05-282432 | 10/1993 |
| JP | 06-084041 | 3/1994 |
| JP | 10-160687 | 6/1998 |
| JP | 10-198174 | 7/1998 |
| JP | 2002-303679 | 10/2002 |
| JP | 2004-050767 | 2/2004 |
| KR | 10-2004-0048552 A | 6/2004 |

* cited by examiner

*Primary Examiner*—Stephen D Meier
*Assistant Examiner*—Sarah Al-Hashimi
(74) *Attorney, Agent, or Firm*—Roylance, Abrams, Berdo & Goodman, LLP

(57) ABSTRACT

An image-forming apparatus and print media recognition method therefor, wherein the apparatus comprises a first light-emitting element for emitting light to a print medium at a predetermined first incident angle, a second light-emitting element for emitting light to the print medium at a predetermined second incident angle, and a light-receiving element installed along an optical axis of total reflection light emitted from the first light-emitting element and reflected from a surface of the print medium. The apparatus further comprises a control unit for controlling the first and second light-emitting elements to alternately emit light for deciding a print medium material based on a reflection amount of light received by the light-receiving element and establishing print conditions adapted to the print media.

16 Claims, 4 Drawing Sheets

IMAGE-FORMING APPARATUS AND PRINT MEDIA RECOGNITION METHOD THEREFOR

CROSS-REFERENCE TO RELATED APPLICATIONS

This application claims the benefit under 35 U.S.C. §119 (a) of Korean Patent Application No. 10-2004-0056534, filed in the Korean Intellectual Property Office on Jul. 20, 2004, the entire disclosure of which is hereby incorporated by reference.

BACKGROUND OF THE INVENTION

1. Field of the Invention

The present invention relates to an image-forming apparatus and print media recognition method therefor. More particularly, the present invention relates to an image-forming apparatus and print media recognition method therefor that is capable of deciding types of print media by the use of a single light-receiving element and a plurality of light-emitting elements, and then performing print tasks adapted to the different print conditions of the media accordingly.

2. Description of the Related Art

Image-forming apparatuses such as printers, combination office machines, and so on, usually perform print jobs using sheets of general printing paper, but can also use a variety of other print media having the properties of transparency, glossiness, or the like, depending on the case. There exists OHP film, coated paper, and so on, for such print media.

In particular, since digital cameras and camcorders are widely used and the demands of users to directly print images are increasing, it is a current trend that image-forming apparatuses more often use a print media such as photographic paper and the like having a sticky surface property.

Thus, the image-forming apparatuses have to establish proper print conditions for print tasks depending on the characteristics of diverse print media so as to provide desired resolutions and image qualities.

In order to check the characteristics of a variety of print media, the conventional image-forming apparatuses have a light-emitting element for emitting light to a print medium at a predetermined incident angle, a first light-receiving element installed to have the same angle as the incident angle of the light-emitting element for measuring the extent of the total reflection of the print medium, and a second light-receiving element installed to be perpendicular to the surface of the print medium for measuring the extent of the irregular reflection of the print medium. In doing so, the conventional image-forming apparatuses check the type of the print media using the extent of the total reflection measured by the first light-receiving element and the extent of the irregular reflection measured by the second light-receiving element.

In such a conventional image-forming apparatus, the light-emitting element can be constructed at a low cost since general light-emitting diodes (LEDs) are employed. However, the light-receiving elements are relatively expensive compared to the light-emitting elements resulting in an undesired increase in the manufacturing cost of the conventional image-forming apparatuses, wherein the light-receiving elements receive light emitted from the LED which is reflected by the print medium and converted into an electric signal.

Accordingly, a need exists for a system and method for deciding a print medium material and establishing print conditions adapted to the print media while providing a reduced manufacturing cost.

SUMMARY OF THE INVENTION

The present invention has been developed in order to solve the above and other problems associated with the conventional arrangement. An aspect of the present invention is to provide an image-forming apparatus having a plurality of light-emitting elements and at least one light-receiving element, and a print media recognition method therefor, which is capable of checking a type of print media using total and irregular reflections and establishing print conditions depending on the type of print media used.

The foregoing and other objects and advantages are substantially realized by providing an image-forming apparatus comprising a first light-emitting element for emitting light to a print medium at a predetermined first incident angle, a second light-emitting element for emitting light to the print medium at a predetermined second incident angle, a light-receiving element installed along an optical axis of total reflection light emitted from the first light-emitting element and reflected from a surface of the print medium, and a control unit for controlling the first and second light-emitting elements to alternately emit light, deciding the material of the print medium based on a reflection amount of light received by the light-receiving element, and establishing print conditions.

Preferably, the image-forming apparatus further comprises a voltage-supplying unit for applying a predetermined input voltage in order for the respective first and second light-emitting elements to emit light.

Preferably, the control unit controls the voltage-supplying unit to apply a gradually increasing voltage to the first light-emitting element until a reflection amount of light emitted from the first light-emitting element to the print medium and received by the light-receiving element reaches a predetermined reference level. The control unit then decides as an input voltage level to be applied to the first light-emitting element, the voltage level applied when the reflection amount of light reaches the reference level.

Preferably, the control unit controls the voltage-supplying unit to apply a gradually increasing voltage to the second light-emitting element until a reflection amount of light emitted from the second light-emitting element to the print medium and received by the light-receiving element reaches a reference level. The control unit then decides as an input voltage level to be applied to the second light-emitting element, the voltage level applied when the reflection amount of light reaches the reference level.

Preferably, if a reflection amount of light emitted from the first light-emitting element to the print medium and received by the light-receiving element is larger than a reflection amount of light emitted from the second light-emitting element to the print medium and received by the light-receiving element, the control unit decides that the print medium is made of a low ink-absorbing material having a large surface friction force.

Preferably, if the print medium is decided to be made of a low ink-absorbing material having a large friction force, the control unit establishes the print conditions to pick up the print media slower and enhance resolution.

Preferably, if a reflection amount of light emitted from the second light-emitting element to the print medium and received by the light-receiving element is larger than a reflection amount of light emitted from the first light-emitting element to the print medium and received by the light-receiving element, the control unit decides that the print medium is made of a high ink-absorbing material having a small surface friction force.

Preferably, if the print medium is decided to be made of a high ink-absorbing material having a small friction force, the control unit establishes the print conditions to pick up the print media faster and lower resolution.

Preferably, the image-forming apparatus further comprises a sensor driving unit for simultaneously moving the second light-emitting element and the light-receiving element in order for light emitted from the second light-emitting element to illuminate a plurality of portions of the print medium.

Preferably, the control unit controls the sensor driving unit to move the second light-emitting element and the light-receiving element and controls the voltage-supplying unit to apply the input voltage only to the second light-emitting element, so as to recognize patterns printed on the print medium based on the reflection amount of light received by the light-receiving element.

Preferably, the second light-emitting element is installed along an axis normal (perpendicular) to the surface of the print medium.

The foregoing and other objects and advantages are also substantially realized by providing a print media recognition method for image-forming apparatuses comprising steps of receiving by the light-receiving element light reflected from the print medium and detecting a reflection amount if the first light-emitting element is applied with a predetermined input voltage and emits light to the print medium, receiving by the light-receiving element the light reflected from the print medium and detecting a reflection amount if the second light-emitting element is applied with a predetermined input voltage and emits light to the print medium, deciding the material of the print medium based on the detected reflection amount, and establishing print conditions based on the decided print medium material.

Preferably, the input voltage applied to the first light-emitting element is a voltage level that is applied when a reflection amount of light reaches a predetermined reference level as determined by applying a gradually increasing voltage to the first light-emitting element until the reflection amount of light emitted from the first light-emitting element to the print medium and received by the light-receiving element reaches the reference level.

Preferably, the input voltage applied to the second light-emitting element is a voltage level that is applied when a reflection amount of light reaches a predetermined reference level as determined by applying a gradually increasing voltage to the second light-emitting element until the reflection amount of light emitted from the second light-emitting element to the print medium and received by the light-receiving element reaches the reference level.

Preferably, if a reflection amount of light emitted from the first light-emitting element to the print medium and received by the light-receiving element is larger than a reflection amount of light emitted from the second light-emitting element to the print medium and received by the light-receiving element, the print medium is decided to be made of a low ink-absorbing material having a large surface friction force.

Preferably, if the print medium is decided to be made of a low ink-absorbing material having a large friction force, the print conditions are established to pick up the print media slower and enhance resolution.

Preferably, if a reflection amount of light emitted from the second light-emitting element to the print medium and received by the light-receiving element is larger than a reflection amount of light emitted from the first light-emitting element to the print medium and received by the light-receiving element, the print medium is decided to be made of a high ink-absorbing material having a small surface friction force.

Preferably, if the print medium is decided to be made of a high ink-absorbing material having a small friction force, the print conditions are established to pick up the print media faster and lower resolution.

BRIEF DESCRIPTION OF THE DRAWINGS

The above aspects and features of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Hereinafter, a number of exemplary embodiments of the present invention will be described in detail with reference to the accompanying drawings.

Figure 1:
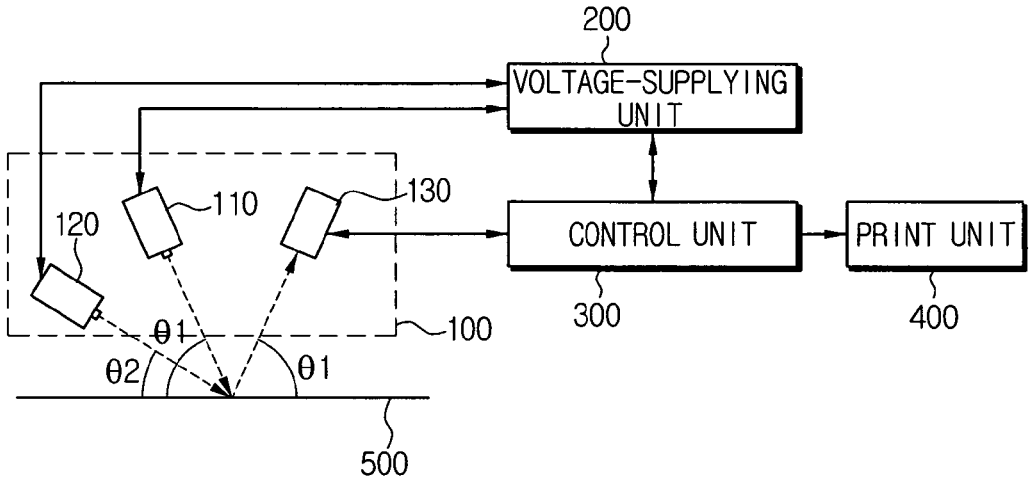
FIG. 1 is a block diagram for showing an image-forming apparatus according to an embodiment of the present invention.

FIG. 1 is a block diagram for showing an image-forming apparatus according to an embodiment of the present invention.

The image-forming apparatus of FIG. 1 includes a media sensing unit 100, a voltage-supplying unit 200, a control unit 300, and a print unit 400, so as to check the type of a print medium 500 and establish proper print conditions according to the type of the print medium 500.

The media sensing unit 100 has first and second light-emitting elements 110 and 120 for emitting light at predetermined incident angles and a light-receiving element 130 for receiving the reflected light.

The first light-emitting element 110 is installed to emit light at a predetermined first incident angle θ1 with respect to the print medium 500. The first light-emitting element 110 is input with a predetermined voltage from the voltage-supplying unit 200, and emits light to the print medium 500.

The second light-emitting element 120 is installed to emit light at a predetermined second incident angle θ2 with respect to the print medium 500. The second light-emitting element 120 is input with a predetermined voltage from the voltage-supplying unit 200, and emits light to the print medium 500.

The light-receiving element 130 is installed along an optical axis of total reflection light reflected from the surface of the print medium 500 on which the first light-emitting element 110 emits the light, receives light reflected from the surface of the print medium 500 on which the first and second light-emitting elements 110 and 120 emit light, and detects an amount of reflection light.

In an exemplary embodiment of the present invention, the light-receiving element 130 is installed along an optical axis of total reflection light reflected from the surface of the print medium 500 on which the first light-emitting element 110 emits light, and wherein such reflection light is hereinafter referred to as an amount of total reflection.

Further, the light reflected from the surface of the print medium 500 on which the second light-emitting element 120 emits light is irregularly reflected, and wherein such reflection light is hereinafter referred to as an amount of irregular reflection.

The voltage-supplying unit 200 applies predetermined voltages so that the first and second light-emitting elements 110 and 120 emit light under the control of the control unit 300.

The control unit 300 controls the first and second light-emitting elements 110 and 120 to be alternately input with the voltage from the voltage-supplying unit 200 and emit light, so that the first and second light-emitting elements 110 and 120 alternately emit light to the print medium 500.

The control unit 300 controls the voltage-supplying unit 200 to decide an input voltage to be applied to the first and second light-emitting elements 110 and 120, and thereafter apply the decided input voltage to the first and second light-emitting elements 110 and 120.

The input voltage applied to the first light-emitting element 110 can be decided by emitting light from the first light-emitting element 110 to a reference sheet of paper. Specifically, a gradually increasing voltage is applied to the first light-emitting element 110 until the amount of total light reflection reaches a predetermined reference level at which point, the input voltage to the first light-emitting element 110 is decided.

Further, the input voltage applied to the second light-emitting element 120 can be decided by emitting light from the second light-emitting element 120 to the reference sheet of paper. Specifically, a gradually increasing voltage is applied to the second light-emitting element 120 until the amount of irregular light reflection reaches a predetermined reference level at which point, the input voltage to the second light-emitting element 120 is decided.

Once the control unit 300 decides the input voltages to be applied to the first and second light-emitting elements 110 and 120, the light is emitted from the first and second light-emitting elements 110 and 120 to the print medium 500 to be measured, and the amounts of total and irregular light reflection are detected by the light-receiving element 130.

If the total reflection amount detected by the light-receiving element 130 is larger than the irregular reflection amount, the print medium 500 has a large surface friction force and a dark surface, so the control unit 300 controls the print conditions to pick up the print medium 500 at a higher speed and use more ink during printing operations.

If the irregular reflection amount detected by the light-receiving element 130 is larger than the total reflection amount, the print medium 500 has a small surface friction force and a bright surface, so the control unit 300 controls the print conditions to pick up the print medium 500 at a lower speed and use less ink during printing operations.

The control unit 300 decides the characteristics of the surface of the print medium 500 by comparing the total reflection amount to the irregular reflection amount, and also decides the type of the print medium 500 by calculating the sum of the total and irregular reflection amounts, the ratio of the total reflection amount to the irregular reflection amount, and so on.

Once the print conditions are established by the control unit 300, the print unit 400 prints data on the print medium 500 according to the print conditions.

Figure 2:
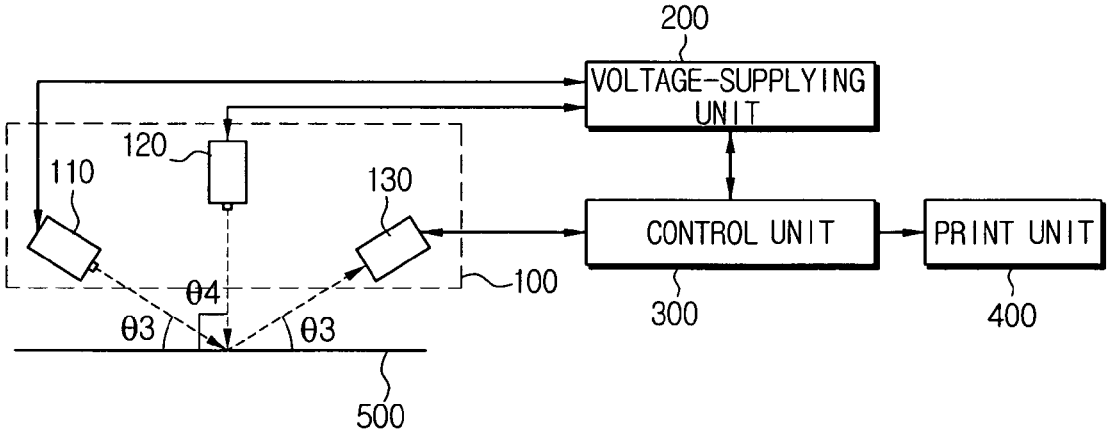
FIG. 2 is a block diagram for showing an image-forming apparatus according to another embodiment of the present invention.

FIG. 2 is a block diagram for showing an image-forming apparatus according to another embodiment of the present invention.

The image-forming apparatus of FIG. 2, as in that of FIG. 1, includes the media sensing unit 100 having the first light-emitting element 110, the second light-emitting element 120, the light-receiving element 130, the voltage-supplying unit 200, the control unit 300, and the print unit 400. Descriptions of functions and features which are substantially the same as those of the components of FIG. 1 will be omitted, and only the different components will be described in greater detail below.

The embodiment of FIG. 2 has the first light-emitting element 110, second light-emitting element 120, and light-receiving element 130 installed at different angles with respect to the surface of the print medium 500.

The first light-emitting element 110 is installed at a predetermined first incident angle θ3, the second light-emitting element 120 is installed along an axis normal (perpendicular) to the surface of the print medium 500, that is, at a second angle θ4=90°, and the light-receiving element 130 is installed along the optical axis of the total reflection light reflected from the surface of the print medium 500 on which the first light-emitting element 110 emits light, that is, at the angle θ3.

In FIG. 2, since the first light-emitting element 110 and the light-receiving element 130 are installed at the same angle with respect the surface of the print medium 500, the light reflected from the print medium 500 on which the first light-emitting element 110 emits light forms the total reflection light. Also, since the second light-emitting element 120 and the light-receiving element 130 are installed at different angles with respect to the surface of the print medium 500, the light reflected from the print medium 500 on which the second light-emitting element 120 emits light forms the irregular reflection light. Thus, the present embodiment of FIG. 2 can achieve the same effect as in FIG. 1.

Figure 3A:
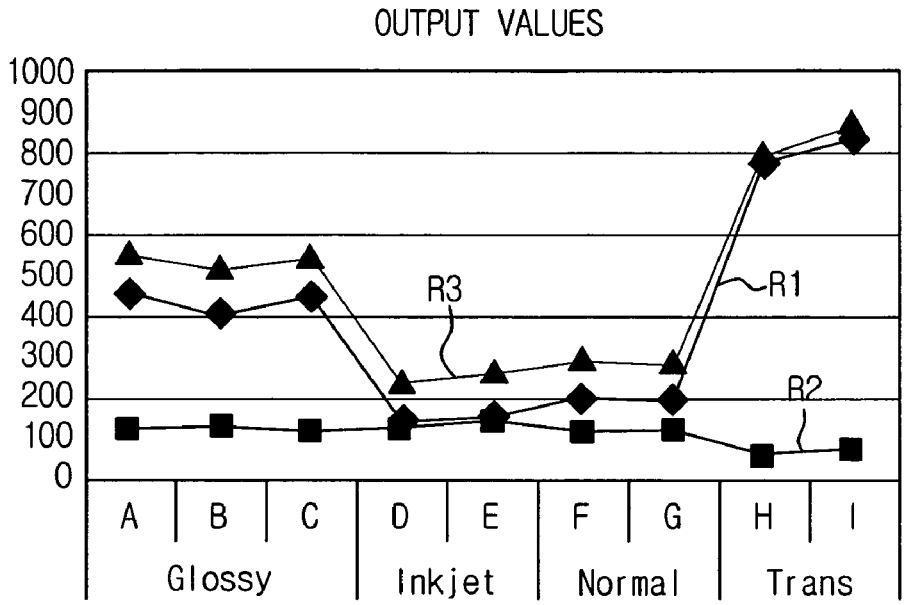
FIG. 3A and FIG. 3B are graphs for explaining the types of print media based on output values of a light-emitting element according to an embodiment of the present invention.
Figure 3B:
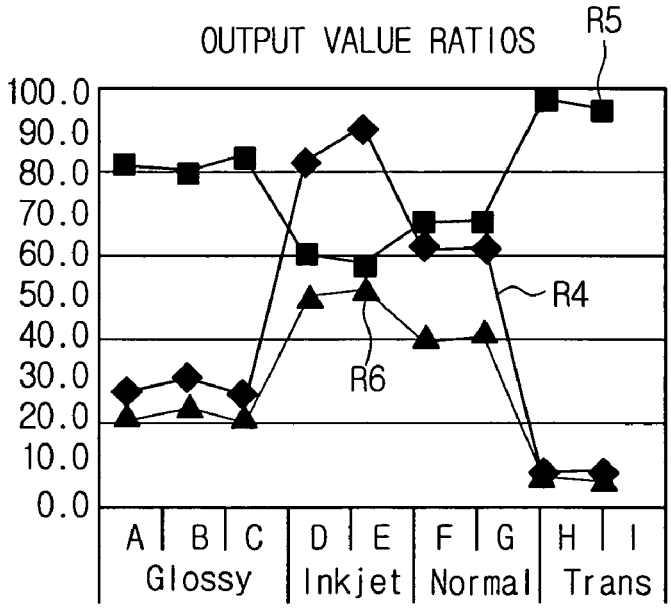

FIG. 3A and FIG. 3B are graphs for explaining an exemplary method of deciding the types of print medium 500 according to the output values of the light-receiving element 130 according to an embodiment of the present invention.

The following Table 1 is provided for an image-forming apparatus as described above, and shows calculation results of the output values of the light-receiving element 130, that is, the total and irregular reflection amounts reflected from the surface of the print medium 500, and the sums and ratios of the reflection amounts that are calculated by the control unit 300.

TABLE 1

| | Output values of light-receiving elements | | | Ratio (%) of the output values of light-receiving elements | | | |
|---|---|---|---|---|---|---|---|
| Print media types | Total reflec. amounts | Irregular reflec. amounts | sums | Irregular amount/total reflec. amount | Total reflec. amount/sum | Irregular reflec. amount/sum | Decision results |
| A | 458 | 128 | 563 | 27.9 | 81.3 | 22.7 | Glossy |
| B | 416 | 129 | 520 | 31.0 | 80.0 | 24.8 | Glossy |
| C | 446 | 125 | 539 | 28.0 | 82.7 | 23.2 | Glossy |

TABLE 1-continued

| Print media types | Output values of light-receiving elements: Total reflec. amounts | Irregular reflec. amounts | sums | Ratio (%) of the output values of light-receiving elements: Irregular amount/total reflec. amount | Total reflec. amount/sum | Irregular reflec. amount/sum | Decision results |
|---|---|---|---|---|---|---|---|
| D | 150 | 123 | 250 | 82.0 | 60.0 | 49.2 | Inkjet |
| E | 157 | 142 | 270 | 90.4 | 58.1 | 52.6 | Inkjet |
| F | 200 | 124 | 296 | 62.0 | 67.6 | 41.9 | Normal |
| G | 199 | 124 | 295 | 62.3 | 67.5 | 42.0 | Normal |
| H | 761 | 63 | 787 | 8.3 | 96.7 | 8.0 | Trans |
| I | 828 | 70 | 876 | 8.5 | 94.5 | 8.0 | Trans |

Table 1 can be illustrated in the graphs of FIG. 3A and FIG. 3B.

FIG. 3A shows a graph including plots for total reflection amounts R1, irregular reflection amounts R2, and sums of the total and irregular reflection amounts R3 based on Table 1, and FIG. 3B shows a graph including plots for ratios of the total and irregular reflection amounts R4, ratios of the total reflection amounts to the sums R5, and ratios of the irregular reflection amounts to the sums R6 based on Table 1.

In FIG. 3A, paper types A, B, and C which have sums R3 ranging from 500 to 600 are decided to be glossy paper having reflection properties, types D and E which have sums R3 ranging from 250 to 270 are decided to be inkjet paper, types F and G which have sums R3 ranging from 290 to 300 are decided to be general paper, and types H and I which have sums R3 ranging from 700 to 900 are decided to be transparent paper.

In FIG. 3A, the inkjet paper (D and E) is not distinctly distinguished from the general paper (F and G), but, in FIG. 3B which shows a graph including plots based on the ratios of the total reflection amount to the irregular reflection amount, the types of paper are more clearly distinguished. In FIG. 3B, the paper types A through I can be easily distinguished by using the ratios R4 of the total reflection amounts to the irregular reflection amounts.

Figure 4:
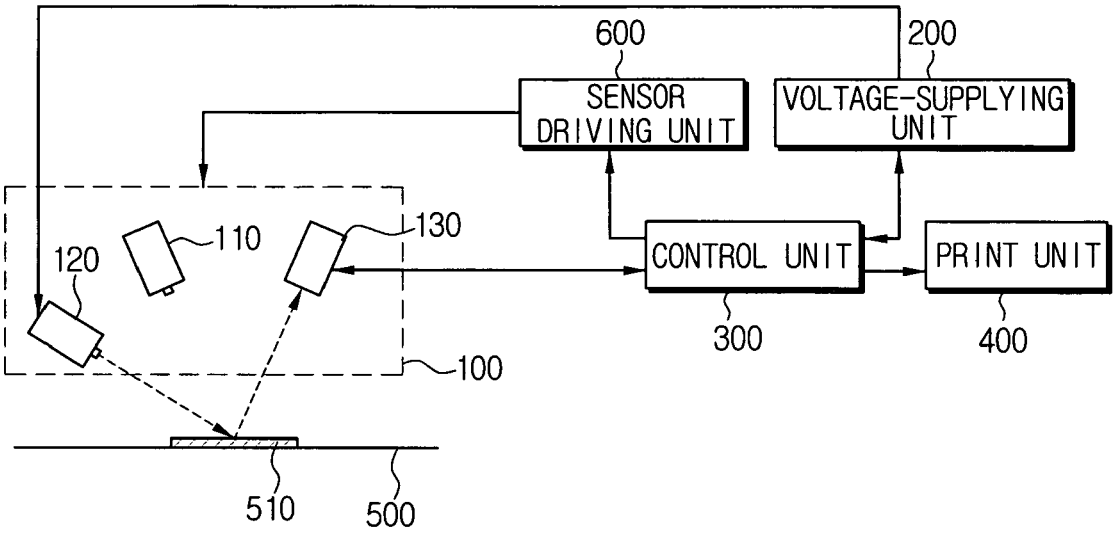
FIG. 4 is a block diagram for showing an image-forming apparatus according to another embodiment of the present invention.
Figure 5:
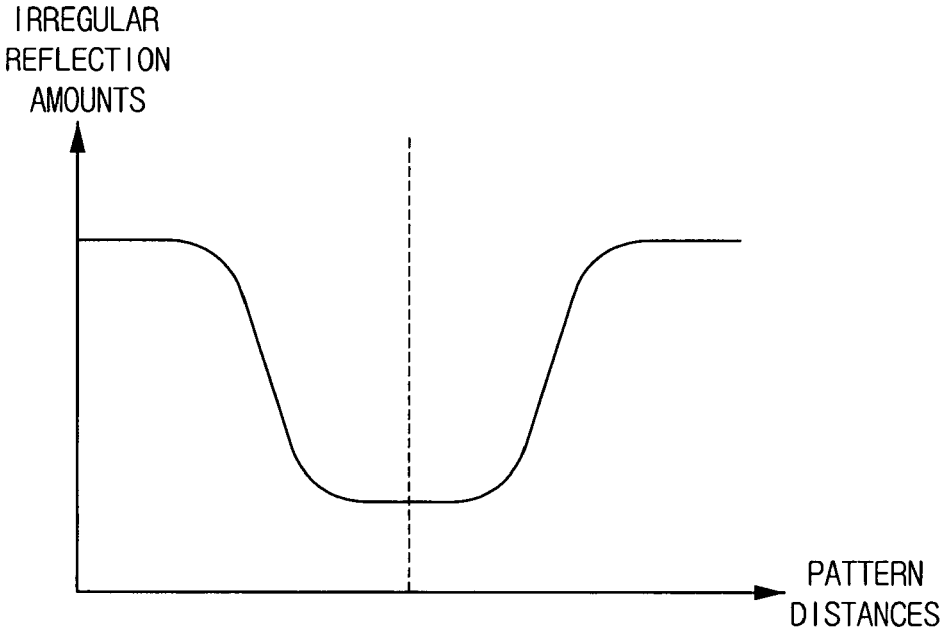
FIG. 5 is a graph for showing a relationship of the output values of the light-emitting element versus the distances between patterns according to an embodiment of the present invention.

FIG. 4 is a block diagram for showing an image-forming apparatus according to another embodiment of the present invention, and FIG. 5 is a graph for showing a relationship of the output values of the light-receiving element 130 of FIG. 4 versus distances between patterns.

The image-forming apparatus of FIG. 4 recognizes patterns printed on the print medium 500 by using the irregular reflection amounts and has a structure similar to that of FIG. 1. Descriptions of functions and features which are substantially the same as those of the components of FIG. 1 will be omitted, and only the different components will be described in greater detail below.

In the embodiment of the present invention shown in FIG. 4, the sensor driving unit 600 moves the media sensing unit 100, wherein the first light-emitting element 110, second light-emitting element 120, and light-receiving element 130 are installed in one body so that the sensor driving unit 600 can simultaneously move the elements 110, 120, and 130 in the same direction.

In the embodiment of FIG. 4, the first light-emitting element 110, second light-emitting element 120, and light-receiving element 130 in the media sensing unit 100 have substantially the same arrangement and angles as in FIG. 1, but in yet another embodiment of the present invention, the media sensing unit 100 may have substantially the same arrangement and angles as in FIG. 2.

The control unit 300 controls the voltage-supplying unit 200 to apply an input voltage only to the second light-emitting element 120, and controls the sensor driving unit 600 to move the media sensing unit 100.

As the media sensing unit 100 moves, the light emitted from the second light-emitting element 120 illuminates a plurality of points on the print medium 500. In FIG. 4, the print medium 500 is a paper having a plurality of portions or points on which patterns 510 are printed.

As the media sensing unit 100 moves, the light emitted from the second light-emitting element 120 and reflected from the print medium 500 is received by the light-receiving element 130. The reflection amount of the light received by the light-receiving element 130 is the amount of irregular reflection.

The embodiments of FIGS. 1, 2 and 4 include the first light-emitting element 110 when providing a method and apparatus for recognizing patterns printed on the print medium 500, however, preferably, the first light-emitting element 110 is not installed in cases wherein the embodiment provides only a pattern recognition function.

Exemplary output values of the light-receiving element 130 are shown in the graph of FIG. 5 when performing a pattern recognition function.

In FIG. 5, the central portion corresponds to the center of a pattern when the irregular reflection amount becomes lowest. As noted above, the output values of the light-receiving element 130 enable the center of a pattern printed on the print medium 500 to be recognized, and enable the distance between patterns to be recognized.

The above recognitions are applied to a test printing or a test page print function, and, in the case of printing single or multiple colors, it can be determined whether the corresponding colors are printed at correct positions and adjustments made.

Figure 6:
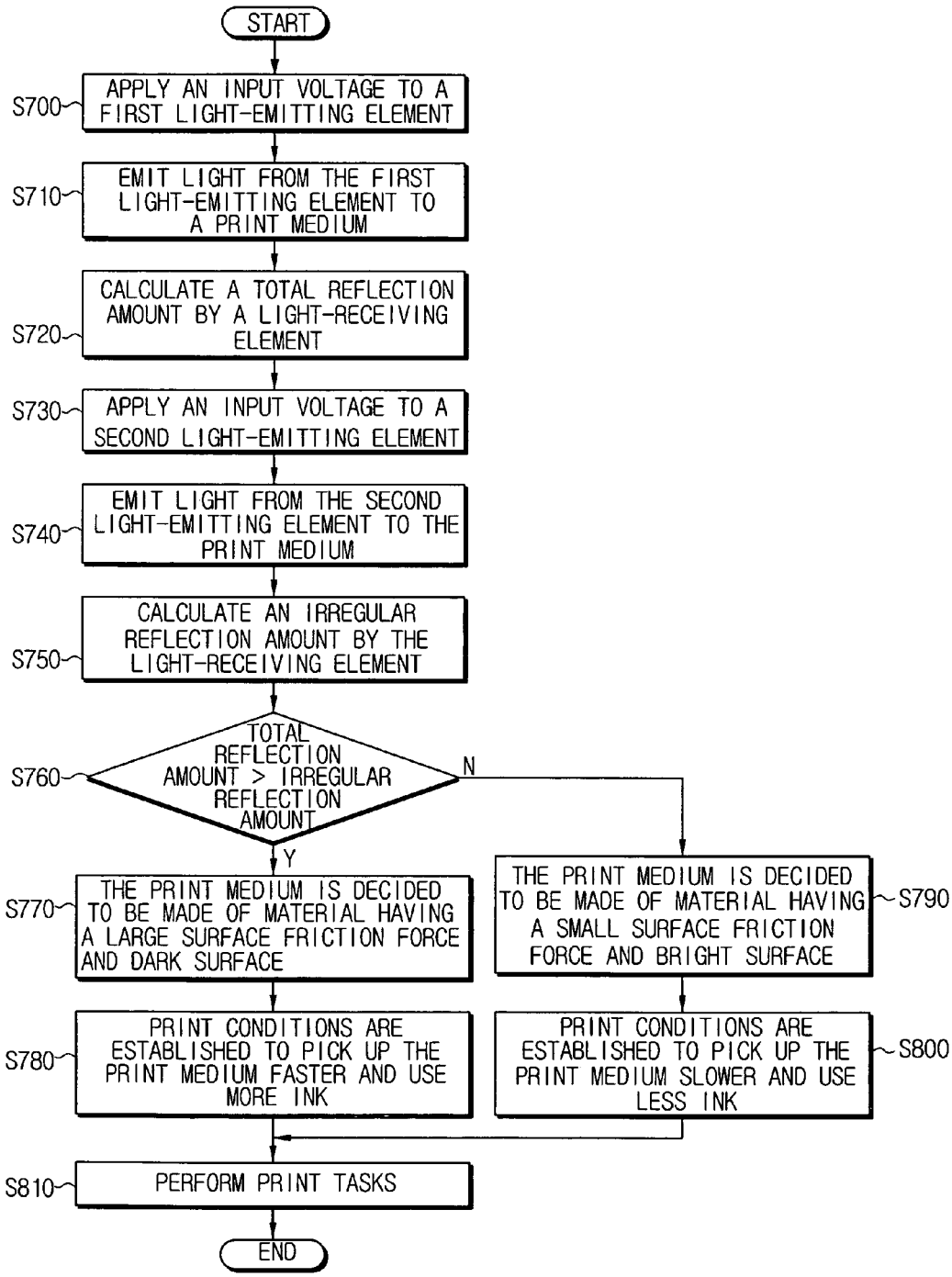
FIG. 6 is a flow chart for explaining a print media recognition method for image-forming apparatuses according to an embodiment of the present invention.

FIG. 6 is a flow chart for explaining a print media recognition method for image-forming apparatuses according to an embodiment of the present invention.

A description will now be made of an exemplary print media recognition method for image-forming apparatuses according to an embodiment of the present invention with respect to FIG. 1 and FIG. 6.

When the print medium 500 to be measured is loaded at a predetermined position, the control unit 300 controls the voltage-supplying unit 200 to apply an input voltage to the first light-emitting element 110, and the voltage-supplying unit 200 then applies an input voltage determined by the control unit 300 to the first light-emitting element 110 at step (S700).

The first light-emitting element 110 to which the input voltage has been applied from the voltage-supplying unit 200 then emits light to illuminate the print medium 500 at step (S710).

The light emitted from the first light-emitting element 110 is reflected from the surface of the print medium 500 and is received by the light-receiving element 130, so that the light-receiving element 130 detects an amount of the total reflection light at step (S720).

Next, the control unit 300 controls the voltage-supplying unit 200 to turn off the input voltage applied to the first light-emitting element 110, and apply an input voltage determined by the control unit 300 to the second light-emitting element 120 at step (S730).

The second light-emitting element 120 to which the input voltage has been applied from the voltage-supplying unit 200 emits light to illuminate the print medium 500 at step (S740).

The light emitted from the second light-emitting element 120 is reflected from the surface of the print medium 500 and is received by the light-receiving element 130, so that the light-receiving element 130 detects an amount of the irregular reflection of the light at step (S750).

The control unit 300 then compares the total and irregular reflection amounts that have been detected by the light-receiving element 130 at step (S760).

In the step (S760), if the total reflection amount is decided to be larger than the irregular reflection amount, the control unit 300 decides that the print medium 500 is made of material having a large surface friction force and a dark surface at step (S770).

The control unit 300 then establishes print conditions to pick up the print medium 500 faster and use more ink for printing operations at step (S780).

In the step (S760), if the irregular reflection amount is decided to be larger than the total reflection amount, the control unit 300 decides that the print medium 500 is made of material having a small surface friction force and a bright surface at step (S790).

The control unit 300 then establishes print conditions to pick up the print medium 500 slower and use less ink for printing operations at step (S800).

After the print conditions are established, the control unit 300 controls the print unit 400 to print data sent from a host (not shown) according to the established print conditions at step (S810).

As described above, the image-forming apparatus and print media recognition method therefor decides the material and type of a print media based on the irregular and total reflection amounts, and performs print tasks according to print conditions suitable to the characteristics of the print media so as to implement high-quality printings.

Further, the present invention controls the pick-up speed according to the surface characteristics of the print media so that it can substantially minimize paper jamming.

Furthermore, the present invention reduces the number of expensive light-receiving elements by the use of a plurality of light-emitting elements and a single light-receiving element, so that the manufacturing cost of the image-forming apparatuses for recognizing the types of print media can be reduced.

The foregoing embodiments and advantages are merely exemplary and are not to be construed as limiting the present invention. The present teachings can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An image-forming apparatus, comprising:

a first light-emitting element to emit light to a print medium at a first location;

a second light-emitting element to emit light to the print medium at a second location;

a voltage-supplying unit to apply an input voltage to the respective first and second light-emitting elements, wherein the first and second light-emitting elements are configured to emit a light level corresponding to the applied input voltage;

a light-receiving element installed along an optical axis of total reflection light emitted from the first light-emitting element and reflected from a surface of the print medium; and a control unit to control the first and second light-emitting elements to alternately emit light to decide a print medium material based on a reflection amount of light received by the light-receiving element, and to establish print conditions adapted to the print medium, wherein the control unit comprises a function to decide that the print medium is made of a low ink-absorbing material having a large surface friction force if a reflection amount of light emitted from the first light-emitting element to the print medium and received by the light-receiving element, is larger than a reflection amount of light emitted from the second light-emitting element to the print medium and received by the light-receiving element.

2. The image-forming apparatus as claimed in claim 1, wherein the control unit further comprises:

a function to control the voltage-supplying unit to apply a gradually increasing voltage to the first light-emitting element until a reflection amount of light emitted from the first light-emitting element to the print medium and received by the light-receiving element reaches a reference level and at which point, an input voltage to be applied to the first light-emitting element is decided.

3. The image-forming apparatus as claimed in claim 1, wherein the control unit further comprises:

a function to control the voltage-supplying unit to apply a gradually increasing voltage to the second light-emitting element until a reflection amount of light emitted from the second light-emitting element to the print medium and received by the light-receiving element reaches a reference level and at which point, an input voltage to be applied to the second light-emitting element is decided.

4. The image-forming apparatus as claimed in claim 1, wherein the control unit further comprises:

a function to establish conditions to pick up a print media slower and enhance resolution if the print medium is decided to be made of the low ink-absorbing material having the large friction force.

5. The image-forming apparatus as claimed in claim 1, wherein the control unit further comprises:

a function to decide that the print medium is made of a high ink-absorbing material having a small surface friction force if a reflection amount of light emitted from the second light-emitting element to the print medium and received by the light-receiving element is larger than a reflection amount of light emitted from the first light-emitting element to the print medium and received by the light-receiving element.

6. The image-forming apparatus as claimed in claim 5, wherein the control unit further comprises:

a function to establish conditions to pick up a print media faster and lower resolution if the print medium is decided to be made of the high ink-absorbing material having the small friction force.

7. The image-forming apparatus as claimed in claim 1, further comprising:

a sensor driving unit to simultaneously move the second light-emitting element and the light-receiving element to illuminate a plurality of portions of the print medium.

8. The image-forming apparatus as claimed in claim 7, wherein the control unit further comprises:

a function to control the sensor driving unit to move the second light-emitting element and the light-receiving element;

a function to control the voltage-supplying unit to apply the input voltage only to the second light-emitting element to illuminate a plurality of portions of the print medium; and a function to recognize patterns printed on the print medium based on the reflection amount of light received by the light-receiving element.

9. The image-forming apparatus as claimed in claim 1, wherein the second light-emitting element is installed along an axis normal to the surface of the print medium.

10. A print media recognition method for image-forming apparatuses having a first light-emitting element to emit light at a print medium at a first location, a second light-emitting element to emit light to the print medium at a second location, and a light-receiving element installed along an optical axis of total reflection light emitted from the first light-emitting element and reflected from a surface of the print medium, the method comprising steps of:

applying a gradually increasing voltage to the first light-emitting element until the reflection amount of light emitted from the first light-emitting element to the print medium and received by the light-receiving element reaches a reference level and at which point, the input voltage applied to the first light-emitting element is decided;

receiving by the light-receiving element a light reflected from the print medium and detecting a reflection amount if the first light-emitting element is applied with an input voltage and emits the light to the print medium;

receiving by the light-receiving element a light reflected from the print medium and detecting a reflection amount if the second light-emitting element is applied with an input voltage and emits the light to the print medium;

deciding a print medium material based on the detected reflection amounts, comprising the step of deciding that the print medium is made of a low ink-absorbing material having a large surface friction force if a reflection amount of light emitted from the first light-emitting element to the print medium and received by the light-receiving element is larger than a reflection amount of light emitted from the second light-emitting element to the print medium and received by the light-receiving element; and establishing print conditions adapted to the print medium based on the decided material of the print medium.

11. The print media recognition method as claimed in claim 10, further comprising the step of:

applying a gradually increasing voltage to the second light-emitting element until the reflection amount of light emitted from the second light-emitting element to the print medium and received by the light-receiving element reaches a reference level and at which point, the input voltage applied to the second light-emitting element is decided.

12. The print media recognition method as claimed in claim 10, further comprising the step of:

establishing print conditions to pick up a print media slower and enhance resolution if the print medium is decided to be made of the low ink-absorbing material having the large friction force.

13. The print media recognition method as claimed in claim 10, further comprising the step of:

deciding that the print medium is made of a high ink-absorbing material having a small surface friction force if a reflection amount of light emitted from the second light-emitting element to the print medium and received by the light-receiving element is larger than a reflection amount of light emitted from the first light-emitting element to the print medium and received by the light-receiving element.

14. The print media recognition method as claimed in claim 13, further comprising the step of:

establishing print conditions to pick up a print media faster and lower resolution if the print medium is decided to be made of the high ink-absorbing material having the small friction force.

15. An image-forming apparatus, comprising:

a first light-emitting element to emit light to a first surface of a print medium at a first location;

a second light-emitting element to emit light to the first surface of the print medium at a second location;

a light-receiving element installed along an optical axis of total reflection light emitted from the first light-emitting element and reflected from the first surface of the print medium; and a control unit to control the first and second light-emitting elements to alternately emit light to decide a print medium material based on a reflection amount of light received by the light-receiving element, and to establish print conditions adapted to the print medium, wherein the control unit comprises a function to decide that the print medium is made of a low ink-absorbing material having a large surface friction force if a reflection amount of light emitted from the first light-emitting element to the print medium and received by the light-receiving element is larger than a reflection amount of light emitted from the second light-emitting element to the print medium and received by the light-receiving element.

16. A print media recognition method for image-forming apparatuses having a first light-emitting element to emit light at a first surface of a print medium at a first location, a second light-emitting element to emit light to the first surface of the print medium at a second location, and a light-receiving element installed along an optical axis of total reflection light emitted from the first light-emitting element and reflected from the first surface of the print medium, the method comprising steps of:

receiving by the light-receiving element a light reflected from the first surface of the print medium and detecting a reflection amount if the first light-emitting element is applied with an input voltage and emits the light to the print medium;

receiving by the light-receiving element a light reflected from the first surface of the print medium and detecting a reflection amount if the second light-emitting element is applied with an input voltage and emits the light to the first surface of the print medium;

deciding a print medium material based on the detected reflection amounts, comprising the step of deciding that the print medium is made of a low ink-absorbing material having a large surface friction force if a reflection amount of light emitted from the first light-emitting element to the print medium and received by the light-receiving element is larger than a reflection amount of light emitted from the second light-emitting element to the print medium and received by the light-receiving element; and establishing print conditions adapted to the print medium based on the decided material of the print medium.

* * * * *